United States Patent [19]

Wulf et al.

[11] Patent Number: 4,880,251

[45] Date of Patent: Nov. 14, 1989

[54] SKI BOOT AND SAFETY BINDING

[76] Inventors: Elmer B. Wulf, 1907 Jasmine, Denton, Tex. 76205; Mark E. Wulf, 24447 Boulevard DeJohn, Plainfield, Ill. 60544

[21] Appl. No.: 224,887

[22] Filed: Jul. 27, 1988

[51] Int. Cl.[4] ..... A63C 9/08

[52] U.S. Cl. ..... 280/613; 36/117; 280/618; 280/634

[58] Field of Search ..... 280/613, 618, 611, 617, 280/634, 636; 36/117, 120, 121

[56] References Cited

U.S. PATENT DOCUMENTS

| | | | |
|---|---|---|---|
| 3,918,732 | 11/1975 | Wulf | 280/613 |
| 3,931,980 | 1/1976 | Marker | 280/613 |
| 4,060,256 | 11/1977 | Collombin et al. | 280/618 |
| 4,658,517 | 4/1987 | Miyoshi et al. | 36/121 |
| 4,667,424 | 5/1987 | Sartor et al. | 36/121 |
| 4,677,769 | 7/1987 | Ahmad et al. | 36/120 |
| 4,712,315 | 12/1987 | Morell et al. | 36/121 |

FOREIGN PATENT DOCUMENTS

| | | | |
|---|---|---|---|
| 0105011 | 4/1984 | European Pat. Off. | 280/613 |
| 0183055 | 6/1986 | European Pat. Off. | 280/613 |
| 2906242 | 8/1980 | Fed. Rep. of Germany | 280/613 |

*Primary Examiner*—David M. Mitchell

*Attorney, Agent, or Firm*—Lee, Mann, Smith, McWilliams & Sweeney

[57] ABSTRACT

A combination of a ski boot and a releasable ski binding which attaches the boot to a ski. The binding includes first connecting portion secured to the ski, second connecting means secure to the boot, and a plunger combination for releasably coupling the first and second connecting portions so that the boot may release from the ski in the forward, backward or lateral directions. The coupling combination includes a pair of plungers aligned in a fore-and-aft arrangement which engage respective spaced sockets. A device is provided for temporarily withdrawing one of the plungers from its engaged socket to permit separation of the first and second connecting portions, and therefore separation of the boot from the ski, without load. The ski boot includes a living hinge in the sole to facilitate walking in the boot. The boot may be locked or unlocked to permit pivoting of boot parts about the living hinge. The boot also includes front and rear cuffs, and a releasable strap securing the two cuffs together which, under predetermined rearwardly-directed load conditions, separate the two cuffs and permits free movement of the rear cuff. The resistance of the ski boot to forward and rear lean is controlled by a pair of oppositely directed springs secured to the front cuff.

40 Claims, 8 Drawing Sheets

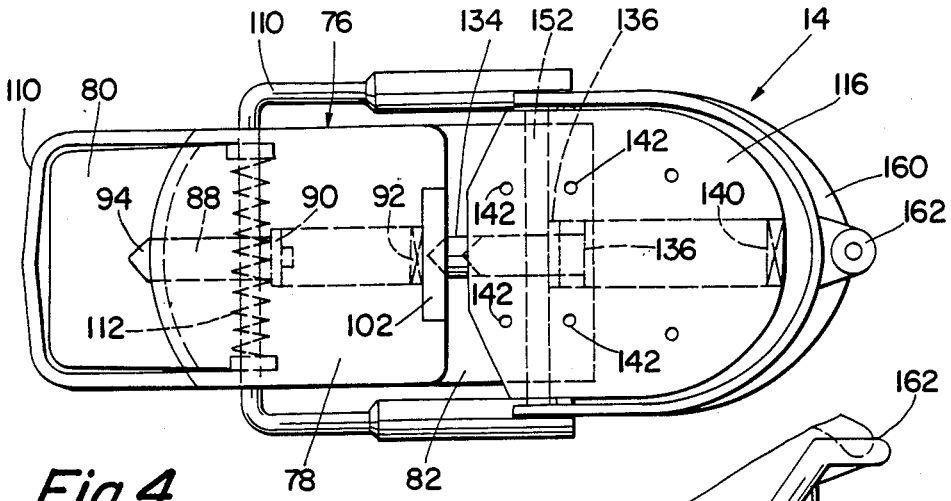
Fig. 4
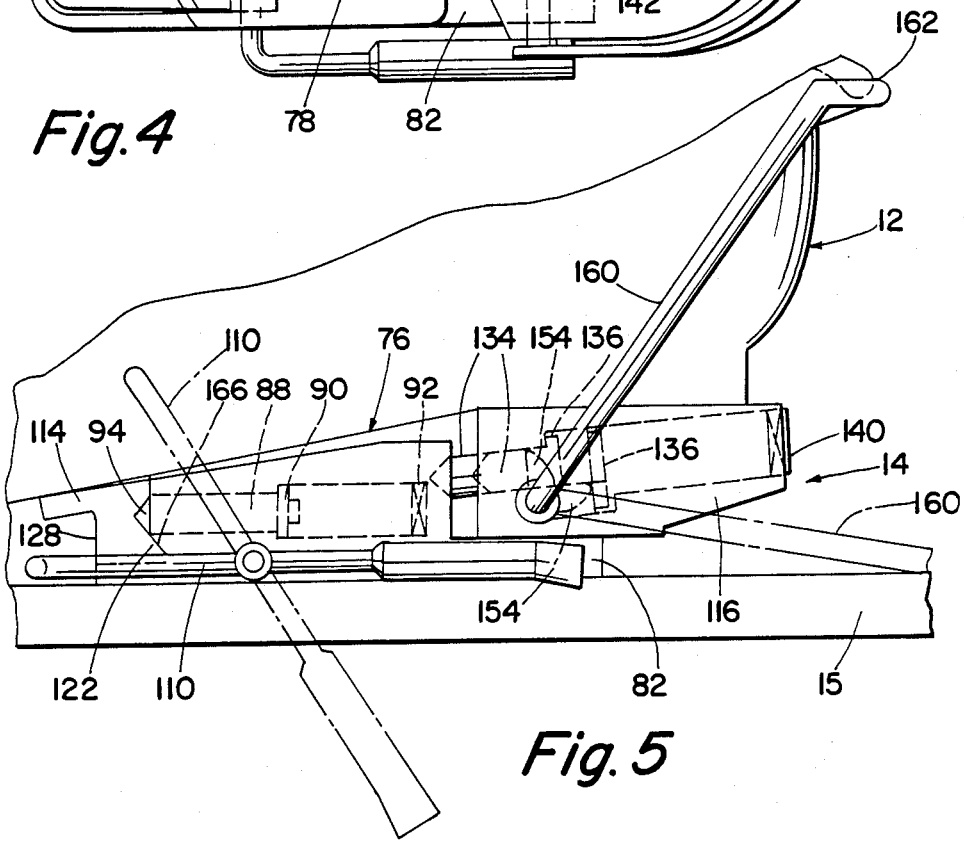
Fig. 5
Fig. 6
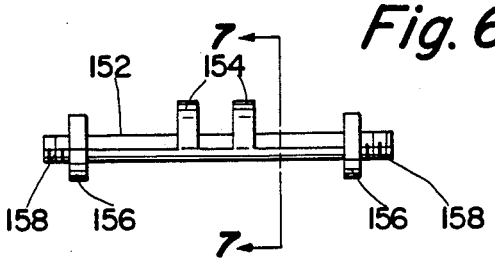
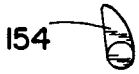
Fig. 7

6°
136
134
102
60°-90°

102
60°-90°
108
134
136

78
15
108
102
104
106

104
106
108
102

124
122
120
122
124
118

90
88
94
70°-90°

96
98

124
118
122
120
122
124
126
114
132
128
126

118
122
30°-45°
126
128
126

96
98

100
98
96
166
30°-45°

Fig.20
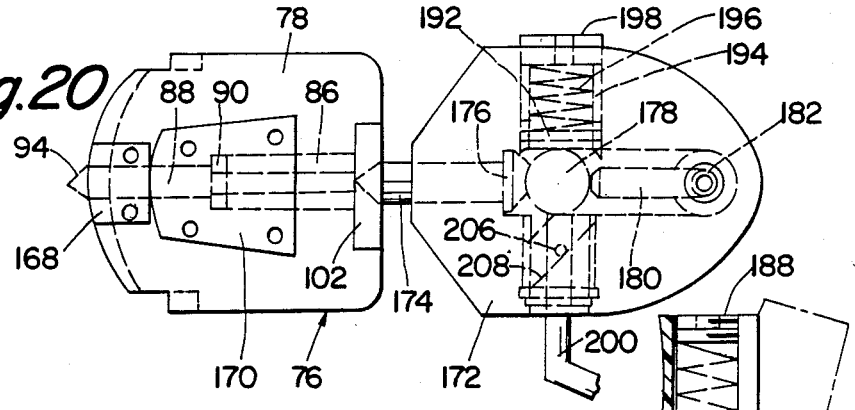
Fig.21
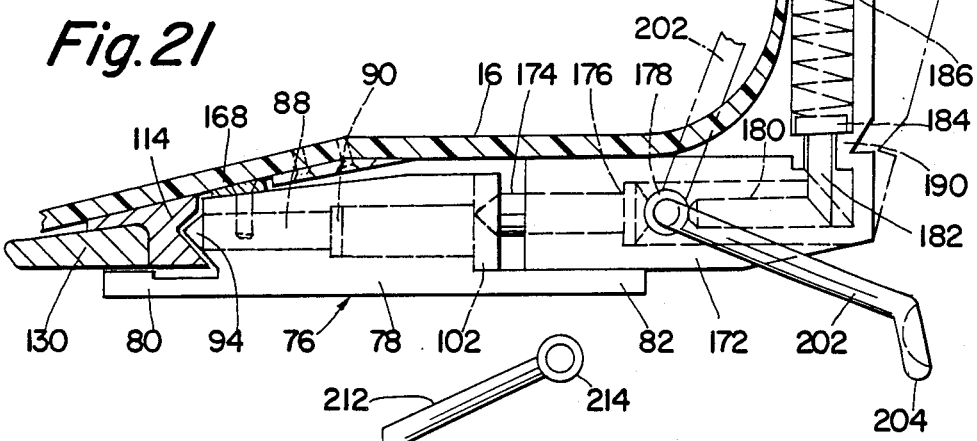
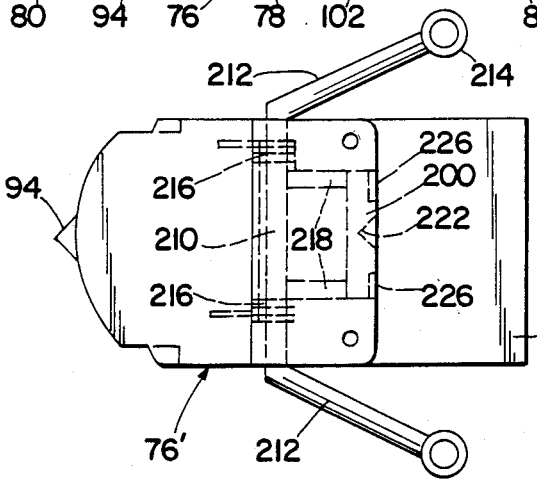
Fig. 22
Fig.23
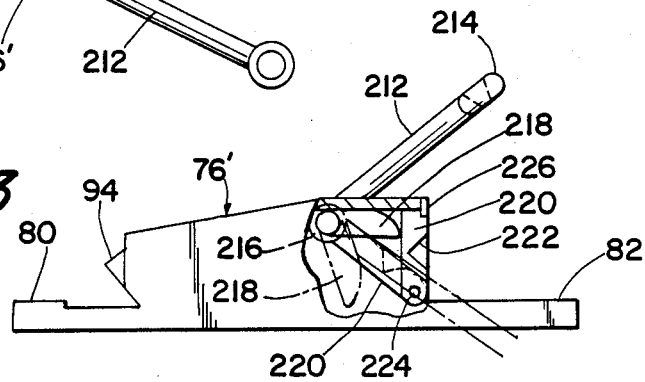

SKI BOOT AND SAFETY BINDING

BACKGROUND OF THE INVENTION

This invention relates to ski boots and ski bindings, and in particular to an operative combination of a ski boot and integral binding which is simple, effective and which allows release in all directions. This invention also relates to improvements in the structure of a ski boot, including the facilitation of walking in the boot, rearward release to prevent knee injuries, and adjustability of the degree of forward and rear lean of the skier's leg when the boot is worn.

As the technology relating to skis and ski boots advances, leg injuries encountered by skiers have been reduced dramatically. However, the vast majority of all commercial skiing combinations comprise a ski boot, a binding for attachment of the boot to a ski, and, of course, a ski. Typically, the manufacturers of the ski, binding and boot are different, leading to the possibility of incompatability, but, more importantly, preventing more radical advances in skiing safety by permitting integration of these three operative elements or of at least the ski boot and bindings. Therefore, bindings, while experiencing minor advances over the years, have still clung to the decades old structure of a toe portion and a heel portion, which clamp respectively to the skier's boot toe and boot heel. Because the typical boot sole is quite long clamping at these great lengths necessitates a rather long lever arm for release.

U.S. Pat. No. 3,918,732 describes a considerable improvement in ski bindings, where the degree of reliability of the release of the binding is increased greatly over conventional heel and toe bindings. However, the structure requires the skier to be somewhat elevated above the ski in relation to elevations with conventional heel and toe bindings, an additional height which may be objectionable to some skiers. Also, with one exception, the binding of this patent is a separate structure from the boot, necessitating an additional plate and therefore additional weight. Thus, while a considerable improvement over conventional heel and toe bindings, the invention of this patent is not the perfect answer to problems encountered with heel and toe bindings.

Conventional ski boots have a relatively stiff, long sole in order to function compatibly with conventional heel and toe bindings. As a result, walking in ski boots for any distance whatsoever is an uncomfortable and awkward procedure. Also, conventional ski boots of the clam shell type (having forward and rear cuffs) have only limited lean, with resistance to change of lean being the same in forward and rearward directions. In this type of ski boot, and indeed, in most modern, stiff ski boots, ankle injuries have largely been eliminated, but, unfortunately, the stiffness of the boot and inability to bend rearwardly has created new knee problems, and in particular tears of the anterior cruciate ligaments. This type of injury can often end a skier's skiing career, or force the truly avid skier to wear a knee brace in order to be able to ski in the future.

SUMMARY OF THE INVENTION

The invention pertains to a combined ski boot and binding for releasably attaching the ski boot to a ski. Included in the combination is first connecting means secured to the ski beneath the boot and a second connecting means secured to the boot, with the second connecting means spanning the first connecting means with portions in a fore-and-aft relationship generally along the length of the ski. The fore portion is located beneath the boot and at least part of the aft portion is located beneath the boot, depending on the form of the invention. Means is provided for releasedly coupling the first and second connecting means so that they may be separated in the forward, backward or lateral directions, or a combination thereof, under predetermined load conditions. The coupling system includes a major plunger means and a minor plunger means aligned with one another and generally parallel to the longitudinal axis of the ski, one of the plunger means being located in the first connecting means and the other of the plunger means being located in the second connecting means. First and second spaced and aligned sockets, each being engaged by one of the plunger means, also comprises part of the coupling system, one of the sockets being located in the first connecting means and the other of the sockets being located in the second connecting means. Each of the plunger means is adjustably urged by a spring into engagement with its respective engaged socket. Finally, the invention includes means for temporarily withdrawing one of the plunger means from its engaged socket to permit separation of the first and second connecting means without load thereon.

In accordance with the preferred embodiment of the invention, the major plunger is located in the aft portion of the second connecting means and the minor plunger is located in the first connecting means. The plungers are oriented in the same direction, facing forward in the normal direction of travel of the ski. The major plunger may be located at an elevation above the ski which is slightly greater than the elevation of the minor plunger means.

Each plunger has a nose formed at a particular angle, with the corresponding socket being similarly shaped. The holding force of the binding which determines release in the lateral direction is thus determined by a combination of that angle, the force of the spring, and the spacing of the sockets, since, for lateral release, one plunger acts as a fulcrum for the other plunger, which releases.

For forward and rear release, fore and aft fulcrum members are mounted on the ski beneath the boot. The fulcrum members may be adjusted to change the lever arm for forward and rear release, and therefore the amount of force required to release the skier from the ski in these directions.

The fore portion of the second connecting means is preferably immediately adjacent to, and in front of, the first connecting means. Thus, any forward thrust of the ski in relation to the skier will not tend to compress the minor plunger means and therefore adversely increase temporarily the lateral release settings for the binding. The fore portion includes a pair of opposed lateral plunger guides to guide the plunger during lateral release of a ski from the combined ski boot and binding of the invention.

In order to withdraw one of the plungers from its socket to permit easy release of the boot from the ski, the one plunger includes an integral collar. A rotatable cam is provided, secured to a shaft and mounted adjacent to and bearing on the collar. A cam actuation arm is secured to the shaft to permit rotation of the shaft, which causes engagement of the cam on the collar, and withdrawing or extending of the one plunger means, depending on the direction of rotation of the actuation arm. Preferably, the one plunger means is located in the aft portion of the second connecting means on the boot, and the actuation arm comprises a release lever extending from one end of the shaft adjacent to the ski boot. The release lever includes an enlarged actuation element for easy gripping by the skier, or for engagement by a ski pole tip to facilitate release. In another form of the invention, the one plunger means is located in the first connecting means on the ski, and the actuation arm comprises a release lever extending from one end of the shaft adjacent to a side of the ski boot.

The major plunger means is mounted to control separation in the forward and rearward directions, while the minor plunger means is mounted to control separation in the lateral direction. Preferably, the sockets are spaced from one another a distance of up to about three inches, thereby creating a lever arm for release in the lateral direction of up to three inches.

In the preferred embodiment of the invention, both plunger means and, indeed the entire second connecting means are located beneath the boot. In another form of the invention, the major plunger is located on the boot in the aft portion of the second connecting means, but the means which adjustably urges the plunger means into engagement with its respective second means comprises a spring which is mounted vertically behind the heel of the boot. A linkage is provided connecting the spring to the major plunger means. In yet another form, the major plunger is located on the boot, and the spring is mounted horizontally on the ski behind the heel of the boot.

The ski boot includes a foot shell and an integral sole. The shell comprises unattached first and second shell segments which are secured to the sole, one of the segments overlapping the other at approximately the location of the ball of a foot when within the boot. The separation of the two shell segments at this location provides a living hinge in the sole in the vicinity of the overlap of the segments. In accordance with the preferred embodiment of the invention, the first segment is mounted to slide within the second segment while pivoting about the living hinge. The invention includes means to lock the first segment relative to the second segment to prevent such sliding when the skier is not walking and when the boot is secured to a ski. The lock means comprises a displaceable stop mounted in the second segment and engaging the first segment. The first segment includes a raised flange captured within the second segment, with the stop engaging one side of the flange when locking of the first and second segments is required.

The ski boot according to the invention includes forward and rear cuffs, and a strap attached to the forward cuff for securing the rear cuff to the forward cuff when the boot is worn. The invention includes means releasably securing one end of the strap to the forward cuff so that under predetermined rearwardly-directed load conditions, the strap will separate from the forward cuff to permit free movement of the rear cuff. The means for releasably securing preferably comprises a notch in the strap and a strap channel in the forward cuff, and includes an adjustable spring-loaded plunger extending into the channel and engaging the notch.

In the preferred form of the invention, the actuation arm for releasing the two connecting means of the binding extends behind the rear cuff. If the strap securing the two cuffs together is released, the rear cuff will tend to automatically disengage the boot from the ski by striking and pushing the arm downwardly as the cuff opens.

The forward cuff is hinged for forward and rearward pivoting of the leg of a skier when the boot is worn. The invention includes means for separately controlling the degree of resistance to forward and rearward lean of the skier, comprising a pair of oppositely directed springs connected between the forward cuff and an immobile portion of the boot. Thus, resistance to forward lean can be increased or decreased relative to the resistance to rearward lean, providing different settings, as desired.

The invention also includes means for setting a minimum forward lean of the front cuff. This means comprises an attitude strap secured to the forward cuff, and also attached to the foot shell of the boot. A series of holes or detents are included in the attitude strap, and a displaceable stop is mounted in an immobile portion of the boot in registration with and engageable with each of the holes or detents in order to adjust the forward lean of the front cuff.

BRIEF DESCRIPTION OF THE DRAWINGS

The invention is described in greater detail in the following description of examples embodying the best mode of the invention, taken in conjunction with the drawing figures, in which:

FIG. 4 is a top plan view of the ski binding portion of the invention, with the ski boot omitted;

FIG. 5 is a side elevational view thereof, shown in relation to the ski and ski boot, and including, in phantom, release positions for the incorporated ski brake and release arm;

FIG. 6 is a plan view of the release cam according to the invention;

FIG. 7 is a cross sectional view taken along lines 7—7 of FIG. 6;

FIG. 20 is a top plan view of an alternative embodiment of the invention, with the ski boot omitted;

FIG. 21 is an enlarged, side elevational view of the alternative embodiment of FIG. 20, with a portion of the ski boot illustrated as well.

FIG. 22 is a top plan view of the ski-mounted portion of the binding of another alternative form of the invention;

FIG. 23 is a side elevational view thereof, showing the release position in phantom.

DESCRIPTIONS OF EXAMPLES EMBODYING THE BEST MODE OF THE INVENTION

Figure 1:
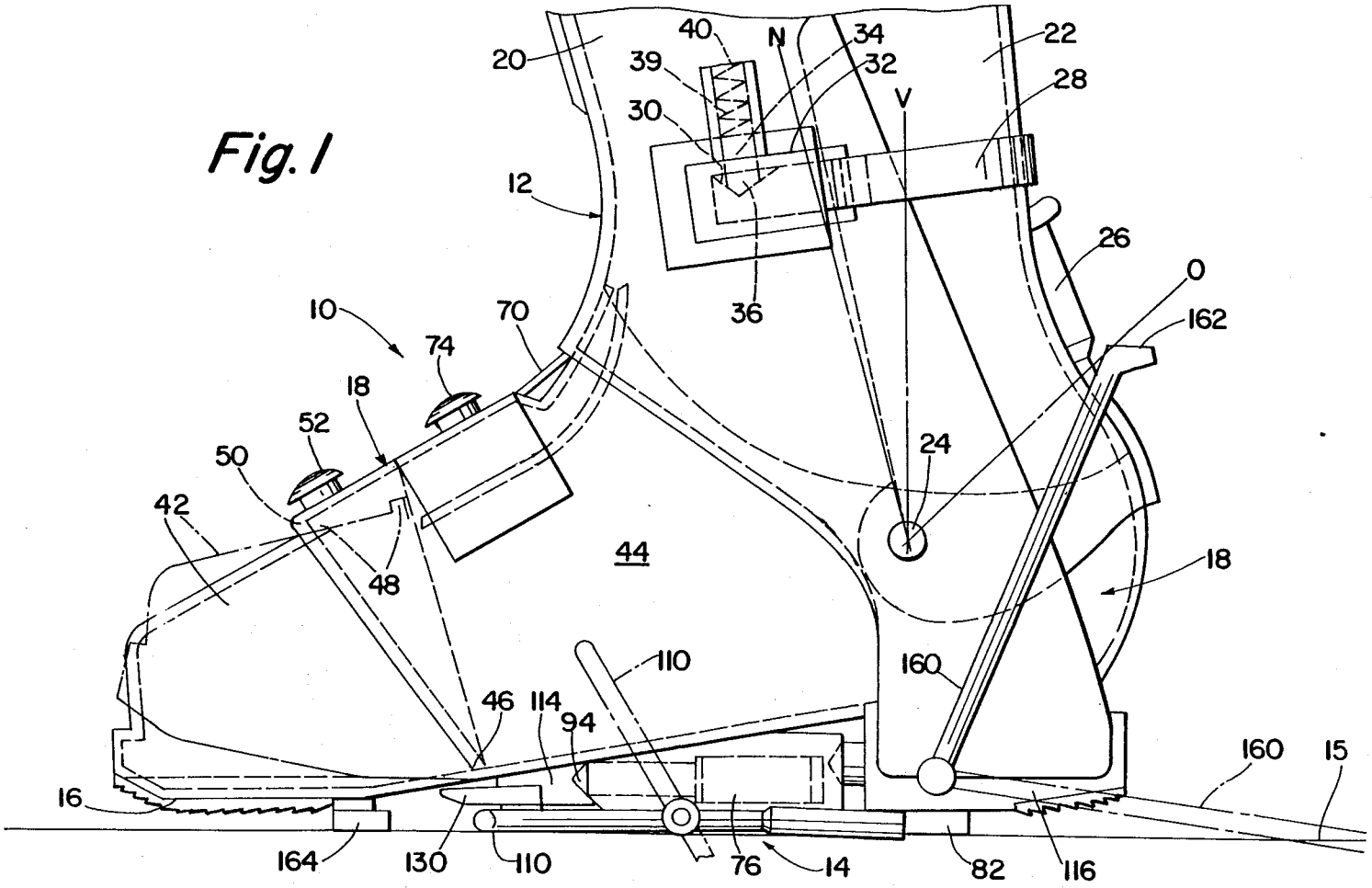
FIG. 1 is a side elevational view of a combined ski boot and binding according to the invention.

A combined ski boot and binding according to the invention is shown generally at 10 in the drawing figures. It is comprised of a ski boot portion 12 and a binding portion 14 which is partially incorporated into the ski boot 12 and partially secured to a ski 15, as will become evident from the following description of the ski boot 12 and binding 14.

The ski boot 12 is of the clam shell type, having an integral sole 16 from which a foot shell 18 extends, and including a forward cuff 20 and a rear cuff 22 which pivot about a central pivot 24 located on opposite sides of the ski boot (only one side of the ski boot being illustrated in the drawing figures). The forward cuff 20 overlies the rear cuff 22, with the portion of the rear cuff 22 beneath the forward cuff 20 being shown in phantom in the drawing figures. The ski boot 12 may also include a conventional adjustment means 26 for adjusting the fit of the boot to the individual wearer's foot.

A strap 28 is used for securing the rear cuff 22 to the forward cuff 20. As is conventional, the strap 28 is secured to one side of the forward cuff 20 and extends about the rear cuff 22, being releasably engaged to the opposite side of the forward cuff 20. The type of attachment of the strap 28 to the one side of the forward cuff 20 has not been illustrated, and may be a buckle or other conventional means which will be quite evident to those skilled in the art. The opposite end of the strap 28 engages means for releasably securing the strap to the forward cuff 20 so that under predetermined rearwardly-directed load conditions, the strap 28 will separate from the forward cuff 20 to permit the rear cuff 22 to freely pivot rearwardly. To this end, the strap 28 includes a notch 30, and a strap channel 32 is secured to or formed in the inside of the forward cuff 20. An adjustable spring-loaded plunger 34 extends into the strap channel 32 and has a plunger nose 36 shaped to engage the notch 30.

Under normal load conditions, the rear cuff 22 bears against the strap 28, which in turn bears against the plunger 34 by means of the notch 30. The plunger 34 is normally held in place by means of a spring 38, the force of which may be adjusted by an adjustment screw 40. If the rearward force exerted by the cuff 22 against the strap 28 exceeds the holding force of the spring 38, the plunger 34 rises against the spring 38, allowing the strap 28 to become disengaged from the plunger 34 and therefore permitting the rear cuff 22 to open. The holding force of the spring 38, as adjusted by the adjustment screw 40, may be varied as desired to aid in preventing an anterior cruciate ligament tear in a skier's knee.

Figure 2:
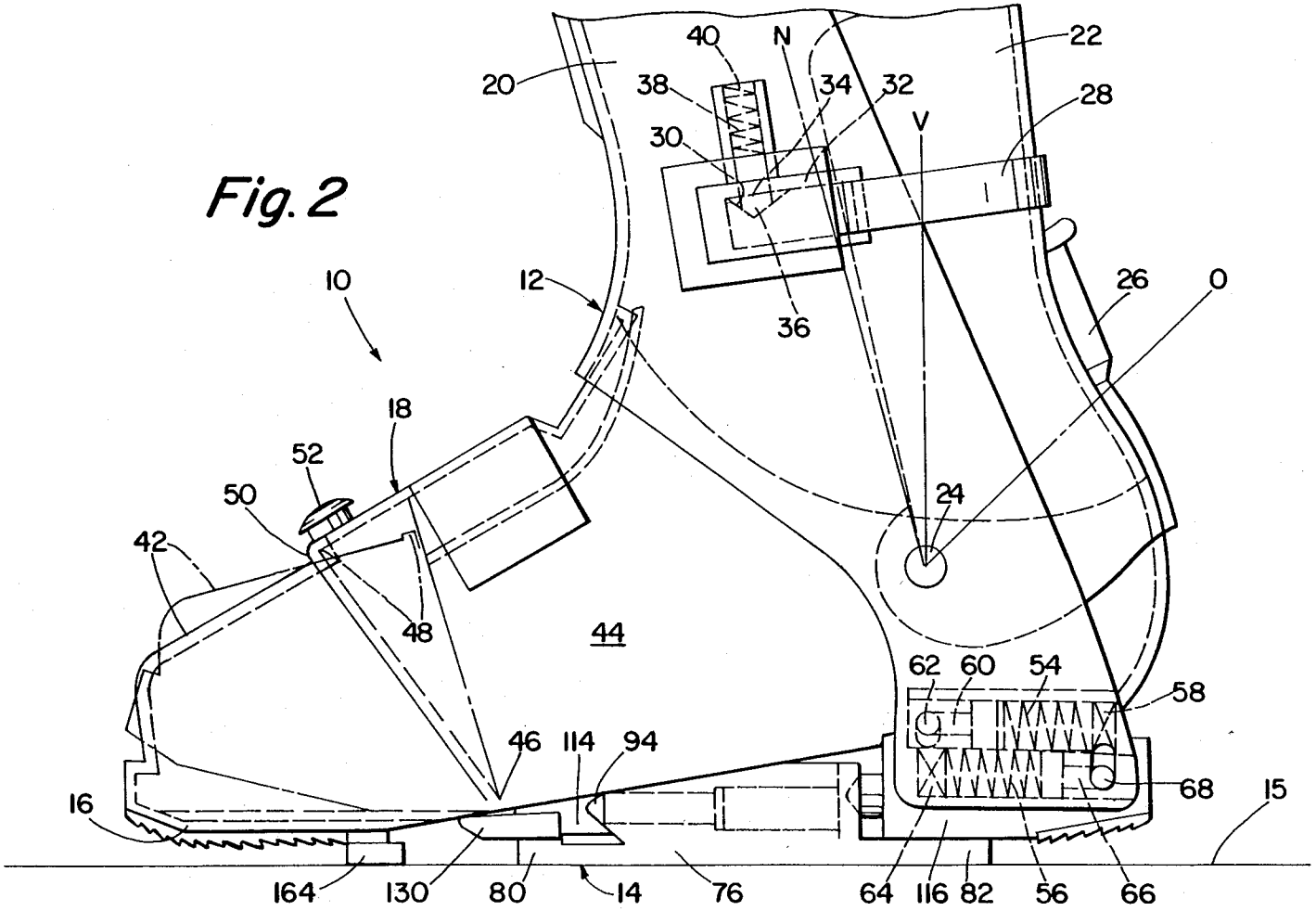
FIG. 2 is a side elevational view similar to FIG. 1, with portions omitted and with the springs for forward and rear lean control being illustrated.

The foot shell 18 is separated into first and second shell segments 42 and 44. As best shown in FIGS. 1 and 2, the second shell segment 44 overlaps the first shell segment 42, creating a living hinge 46 in the sole 16 at approximately the location of the ball of a foot when within the boot. The hinge 46 aids a skier tremendously while walking in a ski boot 12, since the typical ski boot has a rigid sole, thus having a fulcrum point at the toe when walking, rather than at the ball of the foot. The ski boot 12 of the present invention does not suffer that deficiency.

For proper functioning of the binding 14, the sole 16 must normally be rigid, and therefore the fulcruming of the hinge 46 must be eliminated. To this end, the first shell segment 42 includes an upstanding flange 48, and the second shell segment includes a downwardly depending, corresponding flange 50. The flanges interengage as shown so that the shell segment 42 may not be inadvertently withdrawn out of sliding engagement within the shell segment 44. In order to lock the first shell segment 42 relative to the second shell segment 44, a displaceable stop 52 is provided, engaging the flange 48. The stop 52 includes a spring (not illustrated) biasing the stop 52 in the position illustrated so that when the shell segments 42 and 44 are in the bold orientation shown in FIGS. 1 and 2 with the flange 48 sandwiched between the flange 50 and stop 52, the sole 16 is rigid, while if the stop is lifted to permit the flange 48 to pass therebeneath, the sole 16 is allowed to freely pivot about the living hinge 46, as shown in phantom in FIGS. 1 and 2.

Normally, in a clam shell-type ski boot arrangement, the front cuff 20 is rigidly fixed in place, and any forward movement of the cuff is due to either the flexibility of the material of the cuff, or the incorporation of a flexible insert into the cuff. To control both forward and rearward excursion of the cuff 20, incorporated into the ski boot 12 is a pair of springs 54 and 56 which are secured to the front cuff 20. The spring 54, which is adjustable by means of a screw adjustment 58, bears upon a plunger 60 which in turn bears upon a pin 62 secured to either the sole 16 or the foot shell 18. Similarly, the spring 56, which is adjusted by means of a screw adjustment 64, is secured to the forward cuff 20, and bears on a plunger 66 which in turn bears on a pin 68 secured to either the sole 16 or the foot shell 18. The spring 54 compresses upon forward lean against the forward cuff 20, and therefore controls the degree of forward lean, while the spring 56 compresses upon rearward lean of the cuff 20, and therefore controls the degree of rearward movement of the cuff 20 when the ski boot 12 is worn. Due to the separate screw adjustments 58 and 64, it should be evident that the forward and rearward lean can be adjusted independantly of one another.

Figure 3:
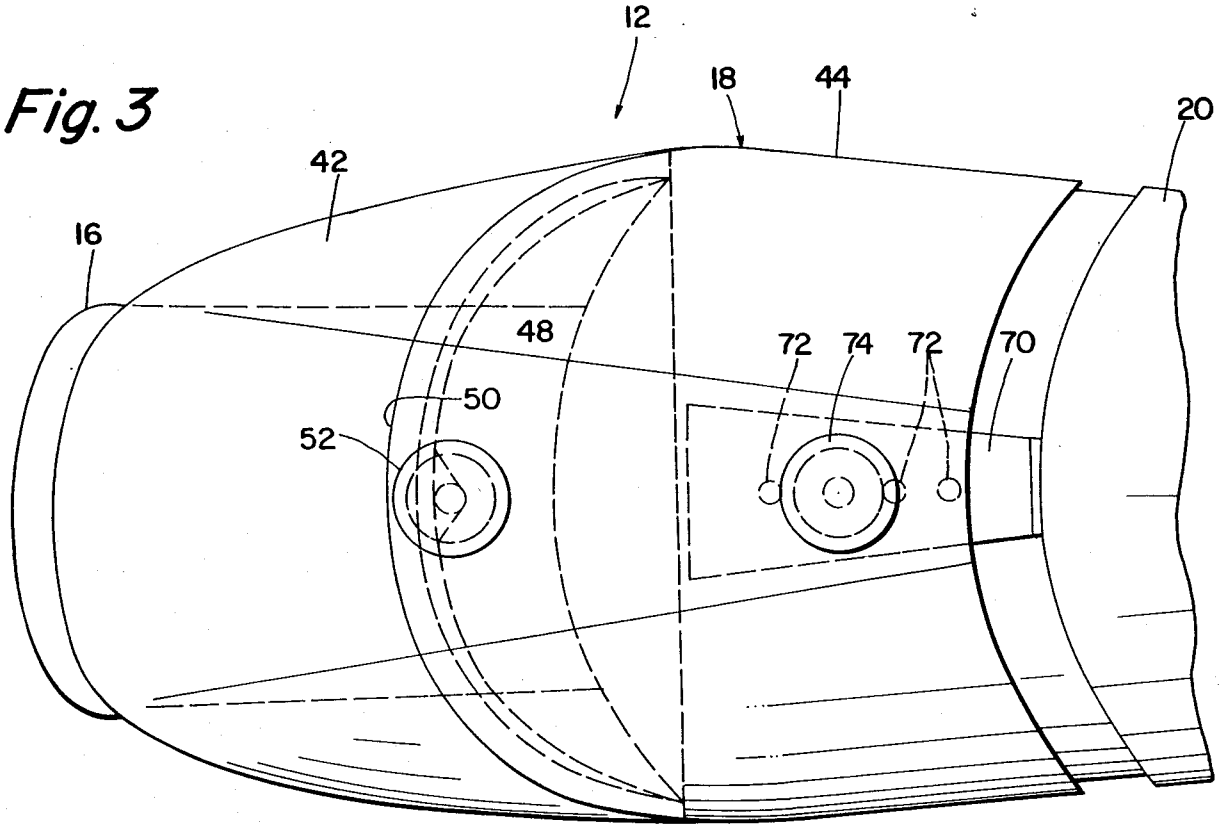
FIG. 3 is an enlarged partial top plan view of the invention, as illustrated in FIG. 1, with the ski omitted.

In a typical ski boot of the clam shell type, the forward cuff is normally locked at a particular angle, so that the skier, when wearing the boot, must stand at that predetermined angle. The ski boot 12 includes means for variably setting the forward lean of the cuff 20. As shown in FIG. 1, the ski boot 12 includes an attitude strap 70 secured to the forward cuff 20, and extending within the foot shell 18. The strap 70 includes a series of holes or detents 72 (FIG. 3), and a displaceable stop 74 is mounted in the shell segment 44 in registration with and engageable with each of the holes 72. The stop 74 is spring biased into the orientation illustrated, and must be lifted to be disengaged from an engaged hole 72.

The vertical is indicated in FIGS. 1 and 2 by V. The normal attitude of the forward cuff 20 is indicated by N, and may be altered depending on adjustment of the attitude strap 70. The open orientation of the rear cuff 22 is indicated by 0, approximately 45 degrees from the vertical V, thus allowing plenty of space for insertion of a skier's foot, and also opening quite adequately to help prevent anterior cruciate ligament tears.

The binding 14 includes two primary portions, a first connecting means secured to the ski 15 beneath the boot 12, and a second connecting means secured to the boot. Those portions are illustrated in detail in the first embodiment of FIGS. 1 through 19.

Figure 8:
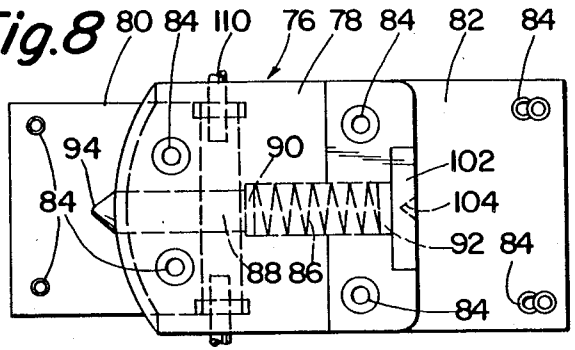
FIG. 8 is a top plan view of yet another form of the ski-mounted portion of the binding of the invention.
Figure 9:
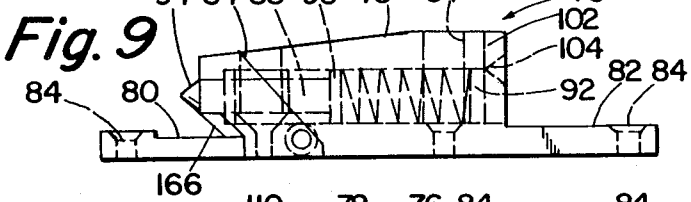
FIG. 9 is a side elevational view thereof.
Figure 10:
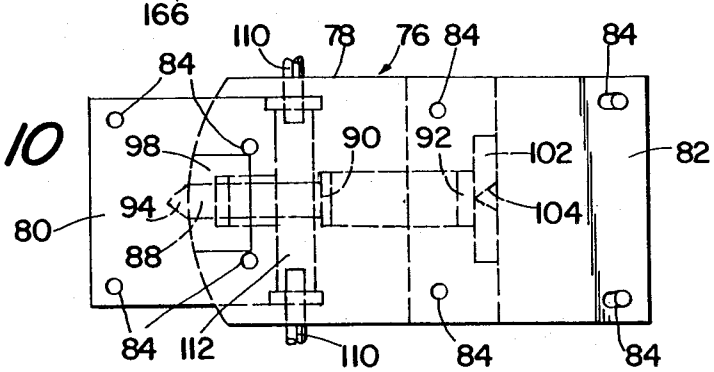
FIG. 10 is a bottom plan view thereof.

The first connecting means is designated generally at 76 in drawing figures, and is best shown in FIGS. 8 through 10. It comprises a central block 78 and extending forward and rear support portions 80 and 82 which are preferably integral extensions of the block 78. The block 78 and support portions 80 and 82 are provided with a series of mounting apertures 84 to permit the connecting means 76 to be securely attached to a ski. It is preferred that at least some of the apertures 84, such as those shown in the support portion 82, be elongated somewhat to accommodate flexing of the ski beneath the connecting means 76.

Figures 14A, 14B, 14C, 15, 16A, 16B, 16C, 17, 18A, 18B, 19:
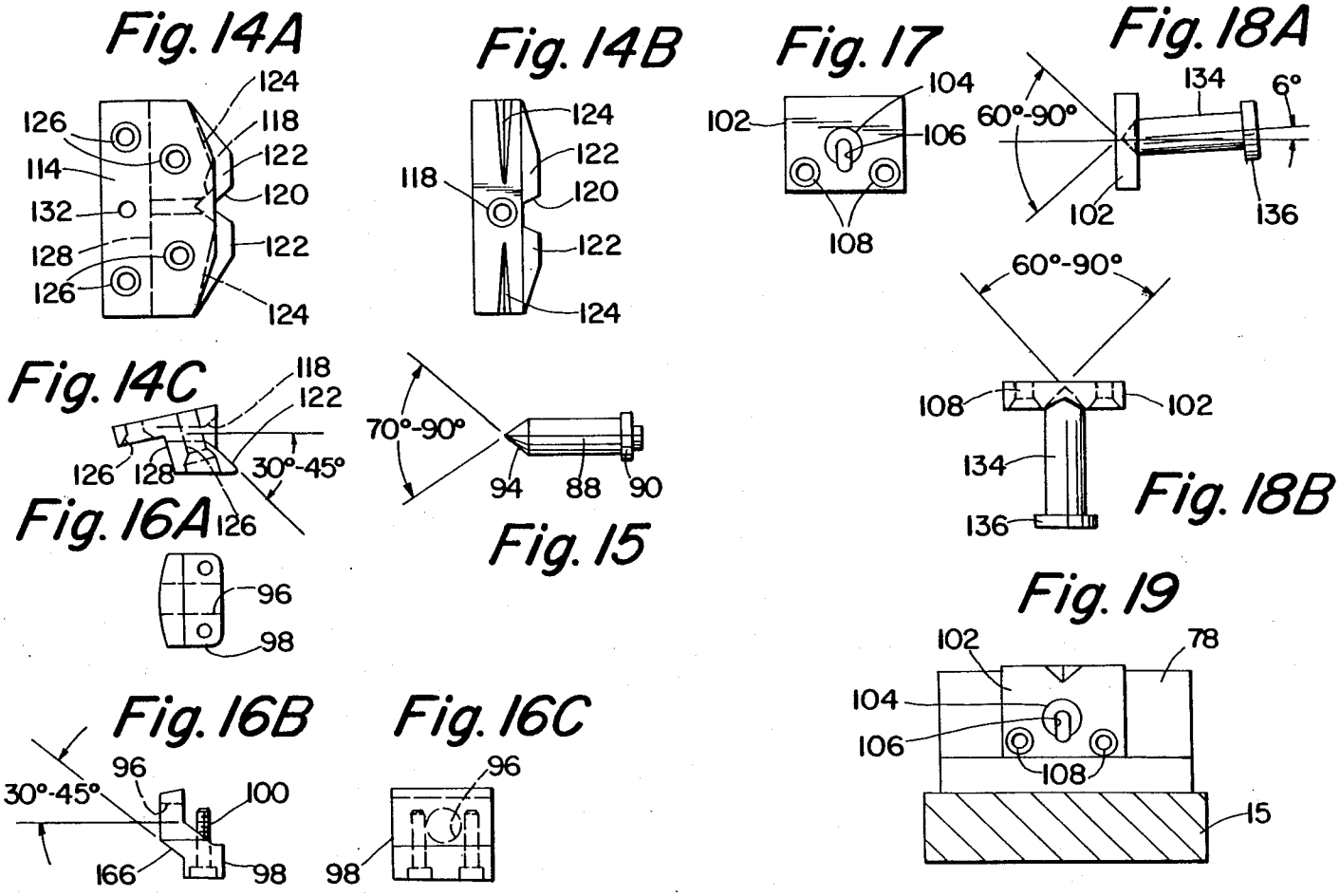
FIGS. 14A, 14B and 14C are, respectively, top, end and side views of the toe socket portion, or fore portion, of the ski binding of the invention.
FIG. 15 is a side elevational view of the front or minor plunger of the invention.
FIGS. 16A and 16B and 16C illustrate, respectively, top, side elevational and rear views of a guide for the plunger for FIG. 11.
FIG. 17 is an elevational view of a socket for the rear, or major, plunger of the invention.
FIGS. 18A and 18B illustrate, respectively, side and top views of engagement of the rear plunger in its socket.
FIG. 19 is an elevational view, partly in cross section, showing the orientation of the socket for the rear plunger in relation to the ski.

The block 78 includes a stepped longitudinal central bore in which a spring 86 and plunger 88 are located. The spring 86 bears against an enlarged head or flange 90 on the plunger 88. An adjustment screw 92 is provided for altering the force with which the spring 86 bears upon the enlarged flange 90. The plunger 88 has an extending nose 94 which, as will be seen below, engages a corresponding socket. The nose 94 extends through a bore 96 in a guide 98 which is preferably of metal and hardened to prevent any gouging or binding. The guide 98 is secured to the block 78 by means of a pair of screws 100 (FIG. 16). A socket plate 102 having a socket 104 and adjustment aperture 106 (for providing access to the adjustment screw 92) is mounted in the block 78 immediately adjacent to the adjustment screw 92. The socket plate 102 is best shown in FIGS. 17 through 19, and may be secured to the block 78 with screws passing through attachment apertures 108.

For halting a runaway ski, the first connecting means 76 also incorporates a conventional ski brake 110 having a spring 112 which biases the brake 110 against the block 78 to a substantially vertical orientation when the ski boot 12 is not attached to ski, that orientation being shown in phantom in FIGS. 1 and 5.

The second connecting means of the binding 14 comprises two parts secured to the ski boot 12. Those parts are a fore portion 114 and an aft portion 116. As best shown in the elevational drawing figures, the aft portion 116 takes the place of a heel of the ski boot 12, while the fore portion 114 is located beneath the arch.

The fore portion 114 preferably comprises a single metallic structure having a socket 118 shaped to be engaged by the nose 94 of the plunger 88. Also, for upward release of the binding 14 at the toe, the fore portion 114 includes a V-shaped gap 120 in a lower extension 122. For guiding the plunger 88 during release or reattachment of the elements of the binding 14, the fore portion 114 also includes a pair of guide grooves 124. For attachment of the fore portion 114 to the sole 16 of a ski boot 12, the fore portion 114 includes a series of holes 126.

The fore portion 114 is provided with a channel 128 which may carry an antifriction device 130 (FIGS. 1 and 2) secured thereto in a hole 132. The antifriction device 130 may be made of any friction-reducing plastic or other composition, as appropriate.

Figure 11:
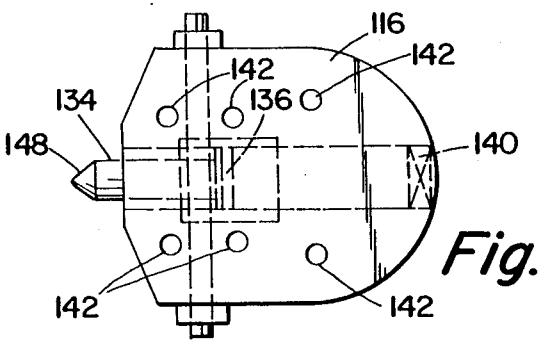
FIG. 11 is a top plan view of the heel portion for the ski boot which engages the ski-mounted portion of the first form of the invention shown in FIGS. 8 through 10.
Figure 12:
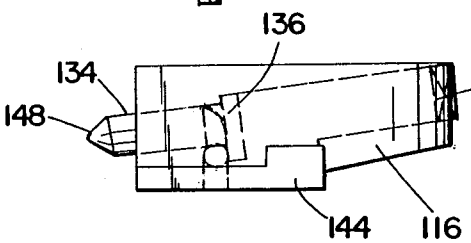
FIG. 12 is a side elevational view thereof.
Figure 13:
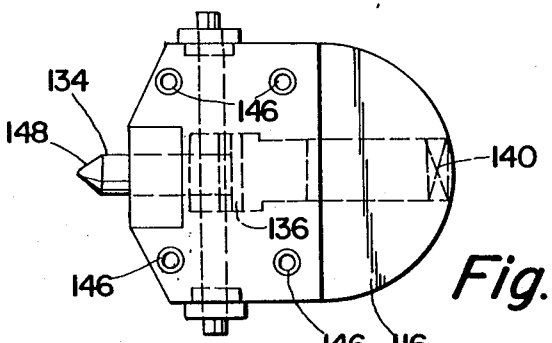
FIG. 13 is a bottom plan view thereof.

The aft portion 116 is best shown in FIGS. 11 through 13. It includes a stepped longitudinal central bore in which are mounted a plunger 134 having a flange 136 engaged by a spring 138 bearing against an adjustment screw 140. Adjustment of the screw 140 determines the compression force of the spring 138 against the flange 136. The aft portion 116 is also provided with a series of attachment aperatures 142 and a removable cover plate 144 which is secured to the aft portion 116 by appropriate fasteners in holes 146.

The plunger 134 includes a nose 148 angled to engage the socket 104. The plunger 134 is mounted to be temporarily withdrawn from the socket 104 to permit separation of the binding 14, and therefore removal of the ski boot 12 from attachment to the first connecting means 76 when secured to a ski 15. To this end, a rotatable lateral shaft 152 is secured within the aft portion 116 and includes a pair of integral cams 154 which are adjacent to, and bear upon, the flange 136. The cams 154 are spaced on opposite sides of the plunger 134. The shaft 152 includes a pair of integral collars 154 to allow proper alignment of the shaft 152, and includes threads 158 at either end. A cam actuation arm or lever 160 is appropriately secured to the threads 158 and extends about the heel of the ski boot 12 when the plunger 134 is in its normal orientation extending from the aft portion 116. The actuation arm 160 includes an enlarged actuation element 162 which may be engaged by the skier's hand or the tip of a skier's ski pole in order to rotate the actuation arm 160 to the released orientation shown in phantom in FIGS. 1 and 5. In that orientation, as best shown in FIG. 5, the plunger 134 is withdrawn the against the force of the spring 138 by the cams 154, and therefore the nose 148 of the plunger 134 is out of engagement with the socket 104.

The noses of the plungers 88 and 134 are angled to aid in adjusting holding force of the binding 14. The angles may range from 50 to 90 degrees, with the mated sockets having corresponding conical angles. Also, the lower extension 122 and mating portion of the block 76 are similarly angled to determine a range of holding force. Those angles may vary from 30 to 45 degrees from horizontal.

The binding 14 functions as follows. With the first connecting means 76 attached to a ski 50, and the fore and aft portions 114 and 116 secured to the ski boot 12, the actuation arm 160 is rotated to the downward position shown in phantom in FIGS. 1 and 5. Doing so causes the cams 154 to withdraw the plunger 134 into the aft portion 116, allowing the skier to step on the ski 15 over the first connection means 76. If desired, a toe guide (not illustrated) can be mounted on the ski 15 to aid in guiding the skier onto the ski 15. When the skier is in the proper orientation, the plunger 88 engages the socket 118, and in order to secure the skier in place on the ski 15, the actuation arm 160 is rotated to the normal orientation shown in the drawing figures, allowing the plunger 134 to engage the socket 104. The skier is then held firmly in place.

The plunge 134 is the major plunger, in that it controls forward and rear release of the binding 14, while the plunger 88 is the minor plunger, in that it provides for a lateral release of the binding 114, the rear plunger 134 serving as a fulcrum point for such lateral release. As explained above, the bearing force of each of the plungers 88 and 134 is adjustable by means of the respective adjustment screws 92 and 140, permitting different release settings to accommodate skiers of different weights and skiing abilities. Because of the different functions served by the plungers 88 and 134, the plungers need not be at equal elevations above the ski 150. Thus, to accommodate the major plunger 134 in the heel of the ski boot 12, the major plunger 134 is located at a greater elevation above the ski 15, and is angled downwardly slightly, as well. That downward angle may be on the order of six degrees.

For release in the forward direction, a fulcrum member 164 is mounted on the ski 150. The location of the fulcrum member 164 determines the lever arm between the fulcrum member 164 and the plunger 134, and therefore, given a particular setting of the spring 138, will dictate the amount of force necessary to separate the ski boot 12 from the ski 15 in the forward direction. Judicious placement of the fulcrum member 164 changes the length of the lever arm, and therefore the forward release characteristics. Similarly, the rear support portion 82 of the block 78 dictates the lever arm for the plunger 134 in the rear release direction. The support portion 82 serves as a fulcrum member for rearward release, and will dictate rearward release characteristics depending upon its extent beneath the boot 12. As explained above, the fore portion 114 includes a lower extension 122 which, as best shown in FIG. 5, extends within a corresponding groove 166 formed in the block 78 and the guide 98. On rearward release, the extension 122 captured beneath the groove 166 forces the ski boot 12 to move forwardly relative to the block 78, compressing the rear plunger 134 against the force of the spring 138. Full release occurs when the nose 94 of the plunger 88 passes through the gap 120.

It is preferred that the sockets 104 and 118 be seperated from one another a distance of up to about 3 inches, therefore providing a very short lever arm for release in the lateral direction. Unlike conventional bindings, which are attached to the toe and heel of the boot, and therefore have a lever arm of typically 12 inches or more, misadjustment of the holding force with the three inch lever arm of the present invention will not tend to have such disasterous effects on the leg of a skier as does misadjustment with a lever arm of 12 inches or more.

FIGS. 20 and 21 illustrate an alternative form of the invention. The first connecting means 76 and fore portion 114 remain the same, and therefore the same reference numerals are used throughout. Also, for the purposes of description, certain items have been omitted for clarity of description. For example, the ski brake 110 has been omitted, although, obviously, it would be used in combination with the block 78. Also, in FIG. 20, certain portions of the first connecting means 76, such as the support portions 80 and 82, have been omitted, but are shown in FIG. 21. The major change between the embodiment of FIGS. 20 and 21 is in the aft portion of the binding and in a separate retention means, both of which are described immediately below.

The block 78 in the embodiment of FIGS. 20 and 21 includes a retention member 168 which is secured thereto. A seperate, second retention member 170 is secured to the underside of the sole 16 of the ski boot 12. As best seen in FIG. 20, when the ski boot is secured to the ski, the retention members 168 and 170 abut. Thus, during skiing, where there sudden decelaration of the ski relative to the skier (and therefore forward momentum of the ski boot relative to the first connecting means 76), the abutting retention members 168 and 170 prevent compression of the two retention plungers, yet do not affect release of the ski boot from the ski in the forward direction, since if the boot rises slightly, as occurs as a forward fall begins, the retention members 168 and 170 no longer abut since the member 170 has risen above the member 168, and therefore the binding is free to release in the normal fashion. The retention members 168 and 170 prevent compression of the plungers due to a forwardly impacting longitudinal force, thus preventing compression of the retention springs and undesired increasing of the release force necessary for the binding to separate.

In the embodiment of FIGS. 20 and 21, the aft portion of the ski binding, generally designated at 172, includes a plunger 174 which engages the socket 104 of the socket plate 102 in a fashion identical to that described above. The socket 174 is terminated by a flange 176 having a spherical surface which engages a ball 178. The ball 178, in turn, engages the similarly-shaped end of a horizontal link 180 which joins, and bears against, a vertical link 182. The vertical link 182 is topped by a flange 184 upon which bears a spring 186 capped by an adjustment screw 188. The adjustment screw 188 is used to vary the bearing force of the spring 186. The flange 184 also bears on a seat 190 which limits the downward excursion of the vertical link 182. Also bearing on the ball 178 is a circular plate 192 extending from a cylindrical housing 194. The diameter of the housing 194 is on the order of at least as great as the diameter of the ball 178. The plate 192 is urged against the ball 178 by a spring 196 within the housing 194 which also bears against an adjustment screw 198.

A horizontal arm 200 bears on the opposite side of the ball 178. The arm 200 extends from the aft portion 172 and is joined to a lever arm 202, which may be integral with the arm 200, and which is topped by an actuation element 204, identical to the actuation element 162. The arm 200 also includes a pin 206 which bears against a fixed camming surface 208.

The compression force of the spring 186 bears through the links 180 and 182 through the ball 178 to the plunger 174. In order to release the compression force of the spring 186 bearing against the plunger 174, the lever arm 202 is rotated to the downward, opened position shown in FIG. 21. During rotation, the pin 206 bears against the camming surface 208, causing the arm 200 to force the ball 178 against the plate 192, compressing the spring 196. The camming surface 208 is also curved, in a fashion not illustrated, to accommodate the rotation of the arm 200 during this procedure. When the ball 178 compresses the plate sufficiently, the plunger 174 is freed and may be withdrawn into the aft portion 172, permitting separation of the ski boot from the ski. Rejoining the ski boot to the ski is via the opposite procedure.

As illustrated in phantom in FIG. 21, the spring 186 need not be vertical in order to function properly. Furthermore, it should be evident that the lever arm 202 may, if desired, be configured to extend behind the ski boot rather than to one side, as shown in FIG. 21.

FIGS. 22 and 23 illustrate an alternative form 76' of the first connecting means. Where elements are identical to elements of the first form of the invention, those elements either bear identical reference numbers, or have been omitted. Also, given the form of the connecting means 76' of FIGS. 22 and 23, and the fact that the means for permitting separation of the first and second connecting means is located in the connecting means 76', obviously the shaft 152 and cams 154 would be eliminated, along with the actuation arm 160, and the aft portion 116 would therefore simply include an internal spring 138 bearing upon a flange 136 of the plunger 134.

The connecting means 76' includes a horizontal shaft 210 from which opposite lever arms 212 extend. The arms 212 may each be topped by an actuation element 214. A pair of springs 216 are engaged about the shaft 210 to maintain the arms 212 in the normal, upright orientation as shown in bold fashion in FIG. 23.

A pair of cams 218 are secured to the shaft 210 and, in the normal orientation, bear against a socket plate 220 carrying a socket 222 which is identical to the socket 104. The socket plate 220 includes a hinge pin 224 about which the plate 220 may rotate. Stops 226 prevent the socket plate 220 from escaping the connecting means 76'.

In the normal orientation shown in FIG. 23, the cams 218 bear against the socket plate 220, and maintain the socket plate 220 in the fixed, upright orientation. However, when either of the lever arms 212 is depressed downwardly, the attached cams 218 are rotated downwardly, and the socket plate 220 is free to pivot about its pivot 224 to the orientation shown in phantom in FIG. 23. In this orientation, the plunger 134 is free of the socket 222, and therefore the fore and aft portions of the second connecting means (not illustrated in these figures) may be removed from the first connecting means 76' to release the skier from the ski.

Figure 24:
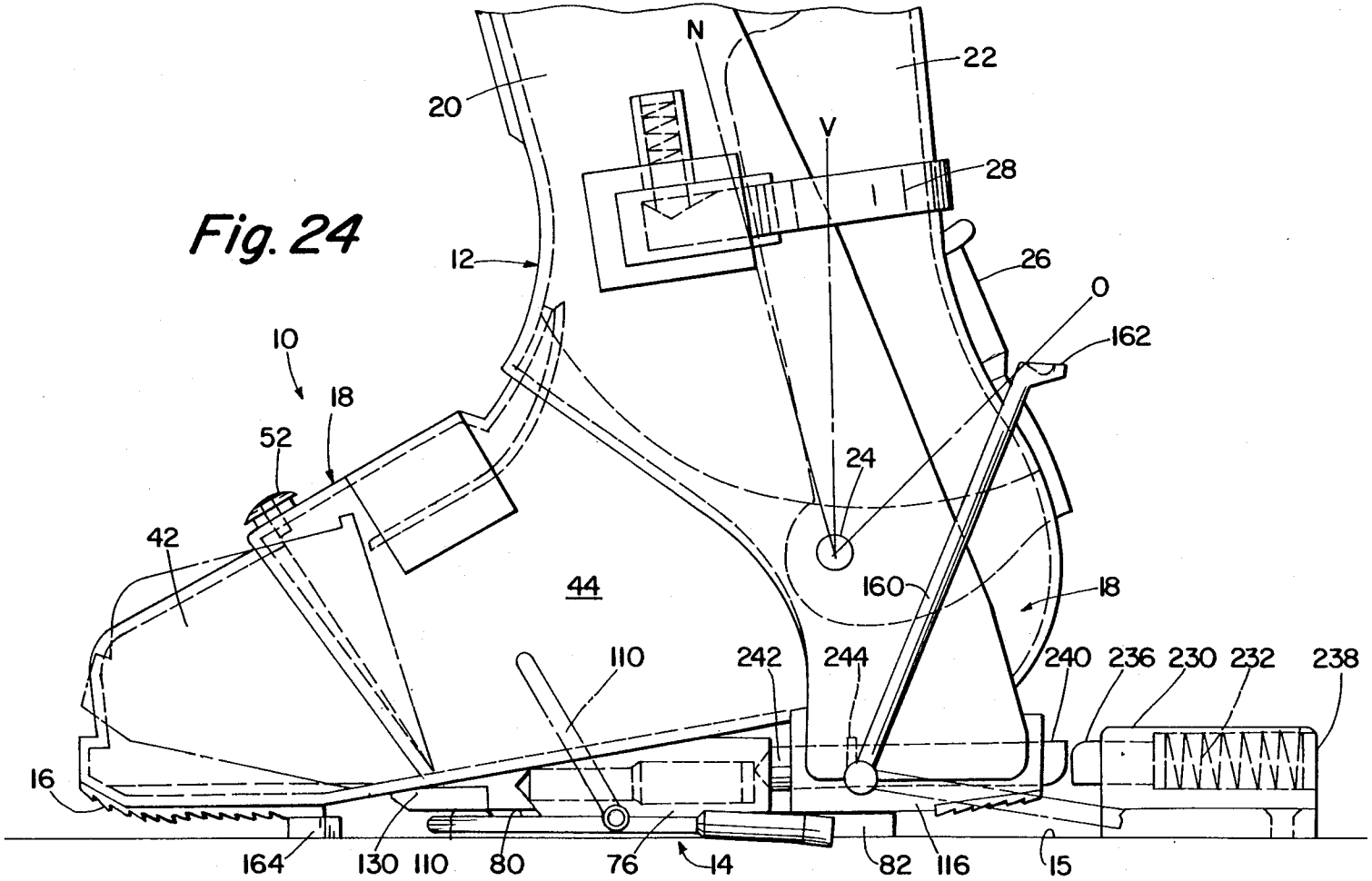
FIG. 24 is a side elevational view of yet another form of the invention.

FIG. 24 illustrates yet another form of the invention. Where elements are identical to those elements described above, the previously-described elements bear identical reference numerals, or, in some cases for purposes of clarity, have been omitted entirely.

In this form of the invention, the first connecting means 76 is identical to that previously described, and is mounted on the ski 15. The second connecting means comprises the fore portion 114, the aft portion 116, and an additional aft portion 230 which is mounted directly on the ski 115. In this form of the invention, no spring is located in the aft portion 116, but rather, a spring 232 is located within the second aft portion 230. The spring 232 is mounted between a collar 234 of a plunger 236 and an adjustment screw 238. The collar 234 bears upon a stop (not illustrated) so that the plunger 236 may extend no farther than illustrated from the aft portion 230. The adjustment screw 238 is used to adjust the bearing force of the spring 232 against the collar 234, and therefore the plunger 236.

When the boot 12 is on the ski 15, the plunger 236 butts against a second plunger 240 which extends through the aft portion 116 and engages a plunger 242 which, in turn engages the socket 104. The plungers 236 and 240, where they abut, are rounded slightly as illustrated to aid in their engagement when the ski boot 12 is mounted on the ski 15.

The same actuation arm 160 and associated mechanism is utilized as in the previous embodiments of the invention, the plunger 242 having an integral collar 244 against which the cams and associated portions of the actuation arm 160 bear. Rotation of the arm 160 will withdraw the plunger 242 from the socket 104, but does not shift the location of the plunger 240 from the orientation illustrated.

It will therefore be seen that the embodiment of FIG. 24 functions identically to the embodiment of FIGS. 1 through 19, the only difference being that no spring is carried in the ski boot 12, that being replaced by the spring 232 and additional plungers 236 and 240.

It will be evident from the foregoing description of examples embodying the invention that the invention may take other forms, as well. Various changes may be made to the invention without departing from the spirit thereof or scope of the following claims.

What is claimed is:

1. In combination, a ski boot and a binding for releasably attaching the ski boot to a ski, comprising a. first connecting means secured to the ski beneath the boot, b. second connecting means secured to the boot, said second connecting means spanning said first connecting means with portions in a fore-and-aft relationship generally along the length of the ski, the fore portion being located beneath the boot and at least part of said aft portion being located beneath the boot, c. means for releasably coupling said first and second connecting means so that said first and second connecting means may be separated in the forward, backward, or lateral directions, or a combination thereof, under predetermined load conditions, said coupling means including i. a major plunger means and a minor plunger means aligned with one another in the same direction and generally parallel to the longitudinal axis of the ski, one of said plunger means being located in said first connecting means and the other of said plunger means being located in said second connecting means, ii. first and second spaced and aligned socket means, each being engaged by one of said plunger means, one of said socket means being located in said first connecting means and the other of said socket means being located in said second connecting means, iii. each of said plunger means including means adjustably urging said plunger means into engagement with its respective engaged socket means, and d. means for temporarily withdrawing one of said plunger means from its engaged socket means to permit separation of said first and second connecting means without load thereon.

2. A binding according to claim 1 in which said major plunger means is located in said aft portion and said minor plunger means is located in said first connecting means.

3. A binding according to claim 1 in which said major plunger means is located at an elevation above the ski which is greater than the elevation of said minor plunger means.

4. A binding according to claim 1 including fore and aft fulcrum members mounted on the ski beneath the boot.

5. A binding according to claim 1 in which each said plunger means includes a plunger nose formed at a predetermined angle and each socket means is formed at a similar predetermined angle, and in which holding force which determines release in the lateral direction is determined by a combination of said angle, said means adjustably urging said plunger means, and the spacing between said socket means.

6. A binding according to claim 1 in which each said plunger means includes a plunger nose formed at a predetermined angle and each socket means is formed at a similar predetermined angle, and in which holding force which determines release in the forward direction is determined by a combination of said angle, said means adjustably urging said plunger means, and the distance from the nose of said major plunger means to a fulcrum member mounted on the ski beneath said boot.

7. A binding according to claim 1 in which said fore portion is immediately adjacent said first connecting means.

8. A binding according to claim 7 in which said fore portion includes a pair of opposed lateral plunger guide grooves.

9. A binding according to claim 1 in which said socket means are spaced from one another a distance of up to about 3 inches.

10. A binding according to claim 1 in which said withdrawing means comprises a flange on said one plunger means and a rotatable cam secured to a shaft and mounted adjacent to and bearing on said flange, and including a cam actuation arm secured to said shaft.

11. A binding according to claim 10 in which said one plunger means is located in said aft portion, and said actuation arm comprises a release lever extending from one end of said shaft adjacent said boot.

12. A binding according to claim 11 in which said release lever includes an enlarged actuation element.

13. A binding according to claim 10 in which said one plunger means is located in said first connecting means, and said actuation arm comprises a release lever extending from one end of said shaft adjacent a side of said boot.

14. A binding according to claim 1 in which said major plunger means is mounted to control separation in the forward and backward directions and said minor plunger means is mounted to control separation in the lateral direction.

15. A binding according to claim 1 in which said major plunger means is located in said aft portion, and in which said means adjustably urging comprises a spring mounted vertically behind the heel of the boot and a linkage connecting said spring to said major plunger means.

16. A binding according to claim 1 in which said ski boot includes a foot shell and an integral, resilient and unitary sole, said shell comprising unattached first and second shell segments both secured to said sole in a fore-and-aft relationship, one of said shell segments overlapping the other of said shell segments at approximately the location of the ball of a foot when within the boot, thereby forming a living hinge in said resilient sole in the vicinity of the overlapping of said segments.

17. A binding according to claim 16 in which said first segment is mounted to slide within said second segment while pivoting about said hinge, and including means to lock said first segment relative to said second segment to prevent such sliding.

18. A binding according to claim 17 in which said lock means comprises a displaceable stop mounted in said second segment and engaging said first segment.

19. A binding according to claim 18 in which said first segment includes a raised flange within said second segment, said stop engaging one side of said flange to lock said first and second segments.

20. A binding according to claim 1 in which said ski boot includes forward and rear cuffs and a strap attached to said forward cuff for securing said rear cuff to said forward cuff, and including means releasably securing said strap to said forward cuff so that under predetermined rearwardly-directed load conditions said strap will separate from said forward cuff to permit free movement of said rear cuff.

21. A binding according to claim 20 in which said means releasably securing comprises a notch in said strap and a strap channel in said forward cuff, and including an adjustable spring-loaded plunger extending into said channel and engaging said notch.

22. A binding according to claim 20 including means for automatically disengaging said coupling means when said means releasably securing has released said rear cuff.

23. A binding according to claim 22 in which said withdrawing means includes an actuation arm attached to said one plunger means and extending behind said rear cuff, said arm withdrawing said one plunger means when rotated downwardly toward said ski, and in which said means for automatically disengaging comprises said rear cuff in combination with said arm.

24. A binding according to claim 1 in which said ski boot includes hinged forward and rear cuffs, which, when fastened about the leg of a skier, permit predetermined forward and rearward leg lean by the skier, and including means for separately controlling the forward and rearward lean.

25. A binding according to claim 1 in which said ski boot includes a hinged forward cuff which, when fastened to the leg of a skier, permits forward lean by the skier, and including adjustable means for setting a minimum forward lean.

26. A binding according to claim 25 in which said ski boot includes a foot shell, and said adjustable means for setting comprises an attitude strap secured to said forward cuff, and means for attaching said strap to said foot shell.

27. A binding according to claim 1 including means for preventing longitudinal forward movement of said second connecting means relative to said first connecting means.

28. A binding according to claim 27 in which said means for preventing comprises a first retention member mounted on said first connecting means and a second retention member mounted beneath said boot, said retention members abutting one another and said second retention member being spaced farther from said fore portion than said first retention member.

29. In combination, a ski boot and a binding for releasably attaching the ski boot to a ski, comprising a. first connecting means secured to the ski, b. second connecting means secured to the boot, c. means for releasably coupling said first and second connecting means so that said first and second connecting means may be separated under predetermined load conditions, and d. a foot shell and an integral, resilient and unitary sole for said boot, said shell comprising unattached first and second shell segments both secured to said sole in a fore-and-aft relationship, one of said shell segments overlapping the other of said shell segments at approximately the location of the ball of a foot when within the boot forming a discontinuity in said shell at the overlapping of said segments, thereby forming a living hinge in said resilient sole in the vicinity of the overlapping of said segments.

30. A binding according to claim 24 in which said first segment is mounted to slide within said second segment while pivoting about said hinge, and including means to lock said first segment relative to said second segment to prevent such sliding.

31. A binding according to claim 30 in which said lock means comprises a displaceable stop mounted in said second segment and engaging said first segment.

32. A binding according to claim 31 in which said first segment includes a raised flange within said second segment, said stop engaging one side of said flange to lock said first and second segments.

33. In combination, a ski boot and a binding for releasably attaching the ski boot to a ski, comprising a. first connecting means secured to the ski, b. second connecting means secured to the boot, c. means for releasably coupling said first and second connecting means so that said first and second connecting means may be separated under predetermined load conditions, d. said boot including forward and rear cuffs and a flexible strap attached to said forward cuff and extending about said rear cuff for securing said rear cuff to said forward cuff, and e. means for releasably securing said strap to said forward cuff so that under predetermined rearwardly-directed load conditions said strap will separate from said forward cuff to permit free movement of said rear cuff.

34. A binding according to claim 33 in which said means releasably securing comprises a notch in said strap and a strap channel in said forward cuff, and including an adjustable spring-loaded plunger extending into said channel and engaging said notch.

35. A binding according to claim 34 including means for adjusting force exerted by said spring-loaded plunger.

36. A binding according to claim 33 in which said cuffs, when fastened about the leg of a skier, permit predetermined forward and rearward leg lean by the skier, and including means for separately controlling the forward and rearward lean.

37. A binding according to claim 36 in which said means for separately controlling comprises a pair of oppositely directed springs connected between said forward cuff and an immobile portion of said boot.

38. A binding according to claim 33 in which said forward cuff, when fastened to the leg of a skier, permits forward lean by the skier, and including adjustable means for setting a minimum forward lean.

39. A binding according to claim 38 in which said ski boot includes a foot shell, and said adjustable means for setting comprises an attitude strap secured to said forward cuff, and means for attaching said strap to said foot shell.

40. A binding according to claim 39 in which said means for attaching comprises a series of spaced catches said attitude strap and a displaceable stop mounted in an immobile portion of said boot in registration with and engageable with each of said catches.

* * * * *